US007040291B2

(12) United States Patent
Veit

(10) Patent No.: US 7,040,291 B2
(45) Date of Patent: May 9, 2006

(54) METHOD FOR REGULATING THE PRESSURE IN A FUEL ACCUMULATOR OF AN INTERNAL COMBUSTION ENGINE

(75) Inventor: Guenter Veit, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/973,324

(22) Filed: Oct. 25, 2004

(65) Prior Publication Data

US 2005/0087174 A1 Apr. 28, 2005

(30) Foreign Application Priority Data

Oct. 24, 2003 (DE) ..... 103 49 628

(51) Int. Cl.
*F02M 37/04* (2006.01)

(52) U.S. Cl. ..... 123/458

(58) Field of Classification Search ..... 123/457, 123/458

See application file for complete search history.

(56) References Cited

U.S. PATENT DOCUMENTS 5,035,223 A * 7/1991 Watanabe ..... 123/459
5,092,301 A * 3/1992 Ostdiek ..... 123/480
5,558,063 A * 9/1996 Minagawa et al. ..... 123/457
5,918,578 A * 7/1999 Oda ..... 123/456
6,024,064 A * 2/2000 Kato et al. ..... 123/179.17
6,279,532 B1 * 8/2001 Takano et al. ..... 123/357
6,450,147 B1 * 9/2002 Demura et al. ..... 123/458
6,578,553 B1 * 6/2003 Schubert et al. ..... 123/458
6,918,367 B1 * 7/2005 Denz et al. ..... 123/179.17
2002/0174855 A1 * 11/2002 Djordjevic ..... 123/458
2004/0055576 A1 * 3/2004 McCarthy, Jr. ..... 123/458

FOREIGN PATENT DOCUMENTS

DE 199 16 100 10/2000

* cited by examiner

*Primary Examiner*—Thomas Moulis
(74) *Attorney, Agent, or Firm*—Kenyon & Kenyon LLP

(57) ABSTRACT

A method for regulating the pressure in a fuel accumulator of an internal combustion engine, in particular in a common rail system is described. The provision of different regulating modes for regulating the pressure in the fuel accumulator is known from the related art. The difference between the individual regulating modes is that, in these modes, only one or multiple independent regulating circuits are active simultaneously to regulate the pressure. A switch-over operation between the regulating modes usually takes place on the basis of different operating states of the internal combustion engine. To minimize disturbances in the pressure in the fuel accumulator during a switch-over operation between two regulating modes, the regulating circuits involved in the switch-over operation are disconnected, and the regulating devices of these regulating circuits are supplied with a suitable switch-over input signal that is predetermined for the switch-over operation in question instead of an input signal representing a system deviation.

19 Claims, 2 Drawing Sheets

METHOD FOR REGULATING THE PRESSURE IN A FUEL ACCUMULATOR OF AN INTERNAL COMBUSTION ENGINE

FIELD OF THE INVENTION

The present invention relates to a method for regulating the pressure in a fuel accumulator of an internal combustion engine, in particular a common rail system. The present invention also relates to a computer program and a device for carrying out this method.

BACKGROUND INFORMATION

German Published Patent Application No. 199 16 100 teaches to provide at least one first and one second regulating circuit to regulate the pressure in a fuel accumulator. In a first regulating mode, only the first regulating circuit is used to regulate the pressure, the pressure in the fuel accumulator being regulated by suitably controlling a high-pressure pump as the pressure regulating means. Alternatively, a second regulating mode is provided in which the pressure is regulated with the help of the second regulating circuit via a pressure regulating valve which acts directly upon the fuel accumulator. Either the first or the second regulating mode is used to regulate pressure as a function of the operating state of the internal combustion engine. For example, a switch-over operation from the first to the second regulating mode occurs upon exceeding certain values of the rotational speed or the fuel volume to be injected in a certain operating state of the internal combustion engine. Suitable criteria are also defined for the complementary switch-over operation from the second to the first regulating mode.

However, the procedure known from the cited publication for switch-over between two different regulating modes results in undesirable disturbances in rail pressure during a switch-over operation.

SUMMARY OF THE INVENTION

An object of the present invention is therefore to refine a known method for regulating the pressure in a fuel accumulator of an internal combustion engine as well as a known computer program and a known device for carrying out this method so that the development of rail pressure is not unacceptably disturbed during a switch-over operation between two different regulating modes.

This method is characterized by the fact that, to carry out the switch-over operation, the regulating circuits involved in the switch-over operation are opened by controlling their regulating devices via switch-over input signals that are preferably predetermined individually for each switch-over operation instead of via the previous input signal, the predetermined switch-over input signals being designed so that the regulating devices are switched in the desired manner from a present operating state defined by the present regulating mode to a future operating state defined by the future regulating mode.

This procedure for carrying out a switch-over operation from an instantaneous regulating mode to a future regulating mode has the advantage that it avoids unwanted disturbances in rail pressure during the switch-over operation. According to the present invention, this is done by continuously switching the regulating circuits involved in the switch-over operation via the switch-over input signal from their activated or deactivated operating states during the present regulating mode over to their new activated or deactivated operating states during the future regulating mode.

Advantages of the Invention

To carry out this homogeneous switch-over operation according to the present invention, the switch-over input signal advantageously represents control values which are individually suitable for each switch-over operation.

In particular, a regulating circuit which changes from an activated operating state to a deactivated one or vice versa during a switch-over operation is advantageously opened to carry out the switch-over operation, i.e., the control loop is interrupted for the duration of the switch-over operation. As mentioned above, the regulating device of the interrupted control loop is no longer operated via the input signal, but via the switch-over input signal, the control value represented by the switch-over input signal being at least approximately adjusted to the system deviations last supplied to the regulating device. This ensures a largely smooth or homogeneous transition from the instantaneous regulating mode to the switch-over operation.

The switch-over control signal is advantageously formed from the preset control values and a rail pressure deviation applied thereto. This rail pressure deviation corrects the fixedly predetermined control values with regard to an instantaneous pressure situation in fuel accumulator 200, the rate at which the pressure is regulated in fuel accumulator 200 being positively influenced with regard to the instantaneous regulation deviation present therein, depending on the absolute value and sign of this pressure deviation. The application of the rail pressure system deviation also minimizes the pressure deviation in fuel accumulator 200 produced by the switch-over operation.

The transitions between steady-state regulating mode and the switch-over operation continue to be smoothed or homogenized in both directions by monitoring, during the switch-over operation, a shift produced by the switch-over input signal in the operating point of at least the regulating device which changes from an activated to a deactivated operating state or vice versa during the switch-over operation. For homogenization purposes, it is advantageous to complete the transition from the switch-over operation to the future regulating mode by disconnecting the switch-over input signal and connecting the usual input signal to the regulating device only after at least the monitored regulating device has actually reached its activated or deactivated operating state provided for the future regulating mode. With regard to a transition from the first to a second regulating mode, in which only one different regulating circuit is activated, it is advantageous with regard to harmonizing the transition to refrain from immediately switching over from the first to the second or from the second to the first regulating mode, but instead to first switch over from the instantaneous first or second regulating mode to the third regulating mode and from there to the second or the first regulating mode.

Finally, it is advantageous to supply each of the regulating devices of the two regulating circuits with an input signal that represents not only the system deviation assigned to the regulating circuit concerned, but also represents the system deviation assigned to the other regulating circuit during the third regulating mode in which both regulating circuits are activated to regulate the pressure in the fuel accumulator.

The above-mentioned object of the present invention is further achieved by a device and a computer program for carrying out the method according to the present invention.

DETAILED DESCRIPTION

The present invention is described in detail below in the form of various exemplary embodiments, with reference to FIGS. 1 and 2.

Figure 1:
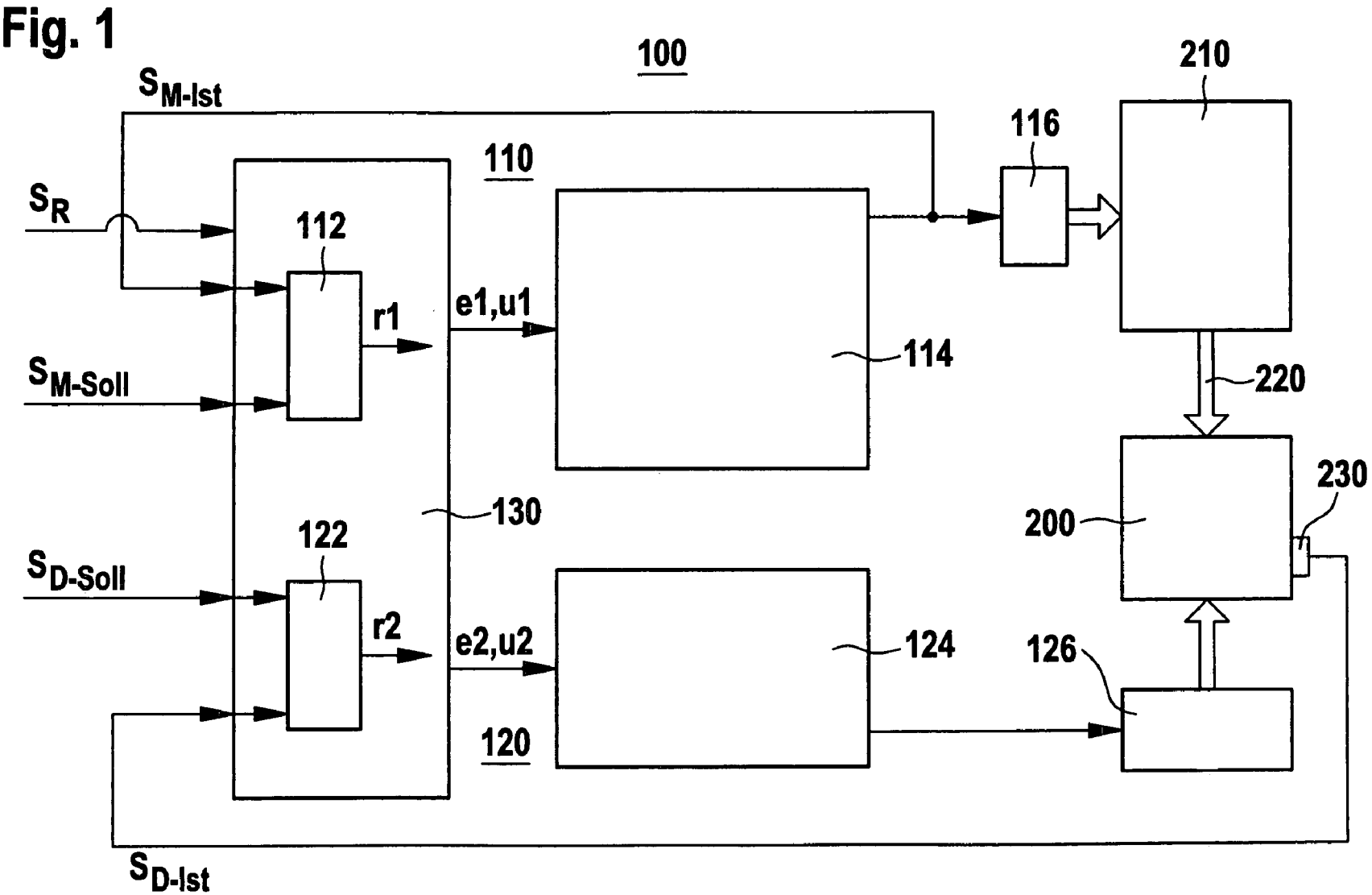
FIG. 1 shows a schematic structure of a device according to the present invention.

FIG. 1 shows the structure of device 100 according to the present invention for regulating the pressure in a fuel accumulator 200 of an internal combustion engine (not illustrated here), according to the present invention. The fuel accumulator is, in particular, a common rail.

The device includes a first regulating circuit 110 having a first subtraction device 112 for providing a system deviation r1, a first regulating device 114 and a throttle valve 116 as the actuator. This first regulating circuit regulates the fuel volume supplied to a high-pressure pump 210 via throttle valve 116. The first regulating circuit ensures that the exact amount of fuel preset by a setpoint volume signal $S_{M\text{-}setpoint}$ of subtraction device 112 is supplied to high-pressure pump 210 via throttle valve 116. For this purpose, subtraction device 112 carries out a continuous comparison between the setpoint fuel volume requested by setpoint volume signal $S_{M\text{-}setpoint}$ and the actual fuel volume provided by throttle valve 116 and represented by actual volume signal $S_{M\text{-}actual}$ and outputs a possibly detected difference r1 between the setpoint and actual volumes in the form of a volume deviation. This volume deviation r1 is output as a system deviation to regulating device 114 in the form of an input signal e1 during a steady-state operation of the first regulating circuit. As a special feature of the first regulating circuit, note that the fuel volume actually metered by throttle valve 116 is not detected, according to FIG. 1, with the help of a flow meter or similar device at the output of throttle valve 116, but instead the controlled variable at the output of first regulating device 114 is evaluated as a representative for the actual fuel volume set. Based on a physically unique assignment between this controlled variable and the fuel volume actually set, this measurement according to FIG. 1 is as effective as a direct detection of the flow volume.

As described above, first regulating circuit 110 first regulates only the volume of fuel supplied to high-pressure pump 210. However, high-pressure pump 210 is connected to fuel accumulator 200 via a fuel line 220. As a result, the pressure in the fuel accumulator is indirectly controllable by controlling the fuel volume supplied to fuel accumulator 200 with the help of the first regulating circuit.

In addition to the first regulating circuit, device 100 according to FIG. 1 also includes a second regulating circuit 120. The latter includes a second subtraction device 122, which detects a possible deviation between a preset setpoint pressure, represented by a signal $S_{D\text{-}setpoint}$, and the actual pressure measured by a pressure sensor 230 in fuel accumulator 200, represented by a signal $S_{D\text{-}actual}$. Second regulating circuit 120 further includes a second regulating device 124, which receives pressure deviation r2 detected by second subtraction device 122 during a steady-state regulating operation in the form of an input signal e2 and which, according to this pressure deviation r2, controls a pressure regulating valve 126, which acts directly upon the pressure in fuel accumulator 200. In comparison to the first regulating circuit, the second regulating circuit therefore regulates the pressure in the fuel accumulator directly.

First and second regulating circuits 110, 120 may thus be operated individually as well as simultaneously, i.e., in parallel. In a first regulating mode, therefore, only first regulating circuit 110 is activated, and in a second regulating mode only second regulating circuit 120 is activated, while in a third regulating mode first and second regulating circuits 110, 120 are activated simultaneously. The decision as to which of the three above-mentioned regulating modes in which the device according to FIG. 1 is operated takes place in response to a regulating mode signal $S_R$, which specifies an instantaneous or future regulating mode, in particular as a function of an instantaneous operating state of the internal combustion engine. FIG. 1 shows that this regulating mode signal $S_R$ is supplied to a regulation management device 130, into which, among other things, both subtraction devices 112 and 122 mentioned above are integrated.

This regulation management device 130 is designed to control regulating devices 114, 124 of the two regulating circuits 110, 120 in response to a desired regulating mode represented by regulating mode signal $S_R$.

Figure 2:
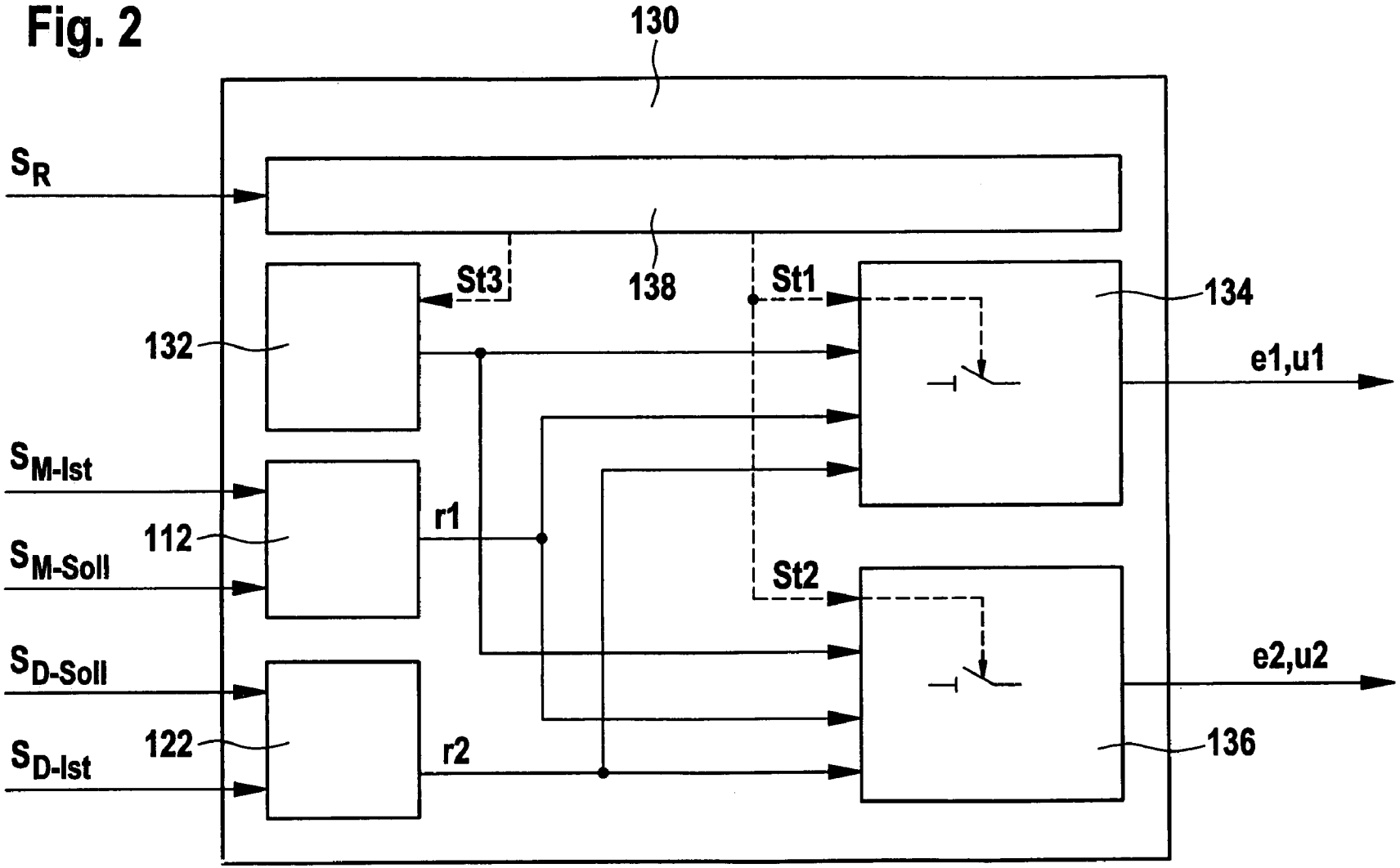
FIG. 2 shows a schematic structure of a regulation management device as an integral part of the device according to the present invention.

FIG. 2 shows the structure according to the present invention of regulation management device 130. The input signals of this unit 130 have been mentioned with reference to FIG. 1; they are identified by the same reference numbers in FIG. 2. The figure shows that, in addition to the two subtraction devices 120, 122, regulation management device 130 also has a memory device 132 for storing and providing predetermined control values. These control values largely form switch-over input signals u1, u2 for regulating devices 114, 124 during a switch-over operation. Regulation management device 130 also includes a first and a second switch-over device 134, 136 for generating first and second input signals e1, e2 for first and second regulating devices 114, 124 during steady-state regulating operation in one of the three above-mentioned regulating modes or to generate switch-over input signal u1, u2 for at least one of regulating devices 114, 124 during a switch-over operation. Finally, regulation management device 130 includes a control device 138 for controlling memory device 132 and switch-over devices 134, 136 in response to regulating mode signal $S_R$ via control signals St1, St2, and St3.

The operation of regulation management device 130 according to the present invention, illustrated in FIG. 2, is described in detail below. A distinction is made between a steady-state regulating operation of device 100 in the three above-mentioned regulating modes and the possible switch-over operations between these regulating modes.

To operate device 100 during a first regulating mode in which the pressure in fuel accumulator 200 is regulated only with the help of first regulating circuit 110, regulation management device 130 operates as follows: in this case, control device 138 controls first switch-over device 134 via first control signal St1 so that switch-over device 134 forms, at its output, input signal e1 for first regulating device 114 so that this signal represents pressure deviation r2 provided by second subtraction device 112. At the same time, control device 138 controls second switch-over device 136 via control signal St2 in such a way that switch-over device 136 generates input signal e2 for second regulating device 124 on the basis of predetermined control values. These control values are provided to second switch-over device 136 by memory device 132 after the latter has received information via third control signal St3 of control device 138 on which control values are to be output from which memory addresses within memory device 132 and sent at the present time to second switch-over device 136. In this case, the control values are preferably predetermined so that they maintain second regulating device 124 in an idle, i.e., deactivated, state. Alternatively, the control values may also shut down second regulating device, preferably switching it over to a standby mode.

When device 100 is operated during the second regulating mode in which the pressure in fuel accumulator 200 is regulated only with the help of second regulating circuit 120, regulation management device 130 operates as follows. Via its first and third control signals St1, St3, it controls memory device 132 and first switch-over device 134 in the same manner as it did second switch-over device 136 in the first regulating mode during the operation described in the preceding paragraph. First switch-over device 134 generates an input signal e1 for first regulating device 114 on the basis of suitable control values provided by memory device 132. These control values are designed in such a way that they deactivate or shut down the first regulating device. During operation in the second regulating mode, second switch-over device 136 is activated by second control signal St2 of control device 138 so that it forms input signal e2 for second regulating device 124 from pressure deviation r2 provided by second subtraction device 122.

If device 100 is operated in the third regulating mode in which the pressure in fuel accumulator 200 is regulated with the help of both first and second regulating circuits 110, 120, regulation management device 130 operates as follows. Control device 138 controls first switch-over device 134 via first control signal St1 so that it forms input signal e1 for first regulating device 114 on the basis of volume deviation r1 provided by first subtraction device 112. At the same time, the control device controls second switch-over device 136 via second control signal St2 so that input signal e2 for second regulating device 124 is formed on the basis of pressure deviation r2 provided by second subtraction device 122. However the input signals are advantageously formed not only on the basis of the above-mentioned deviations, but also by additionally taking into account the other deviations r1, r2.

Up to this point, we have described the performance of regulation management device 130 for steady-state regulation in either the first, second or third regulating modes. In the discussion below, the performance according to the present invention of regulation management device 130 during a switch-over operation in which the switch-over is carried out between an instantaneous regulating mode to a desired future regulating mode in response to regulating mode signal $S_R$. To carry out this switch-over operation, regulation management device 130 is designed to open the regulating circuits involved in a switch-over operation by controlling their regulating devices 114, 124 via special switch-over input signals u1, u2 instead of via input signals e1 or e2, as was previously the case in steady-state regulating operation. These switch-over input signals are designed to switch over regulating devices 114, 124 in the desired manner from the instantaneous operating state (active or passive) defined by the instantaneous regulating mode to a future operating state (active or passive) defined by the future regulating mode.

Switch-over input signals u1, u2 are, in principle, based on suitably predetermined control values provided by memory device 132. The control values are predetermined for each individual possible switch-over operation between two different regulating modes. According to the structure of regulation management device 130 illustrated in FIG. 2, first and second switch-over devices 134, 136 are controlled by first and second control signals St1, St2 during a switch-over operation so that they generate switch-over signals u1, u2 on the basis of suitable control values provided by memory device 132. Memory device 132, in turn, is instructed to do this by third control signal St3.

To optimize the rate at which the pressure is to be varied or regulated during a switch-over operation in fuel accumulator 200, it is advantageous for switch-over input signals u1, u2 to be formed not only from the control values alone, but instead for them to be formed from control values to which instantaneous pressure deviation r2 provided by second subtraction device 122 has been applied. Depending on the absolute value and sign of this pressure deviation, switch-over input values u1, u2 depend to a greater or lesser extent on the originally predetermined control values; this not only optimizes the rate of regulation with regard to the instantaneous pressure situation in the fuel accumulator, but it also minimizes the pressure deviation produced by the switch-over operation.

Control device 138 may also be designed as a state machine, which makes it possible to monitor the operating points of regulating devices 114, 124 during a switch-over operation.

During a switch-over operation from the third regulating mode, in which both regulating circuits are active, to the first or second regulating mode, in which only one regulating circuit is active at a time, the following steps are carried out: First, both regulating circuits 110, 120 are opened by controlling them via switch-over input signals u1, u2 instead of via input signals e1, e2 as was previously the case. The shift in the operating points of both regulating devices 114, 124 produced by switch-over input signals u1, u2 is then monitored, in particular with regard to when the regulating device to be deactivated during this switch-over operation leaves its previous active operating range. Upon reaching this point in time, switch-over input signal u1, u2 which was input earlier, is shut off, while the regulating device remains active. The corresponding regulating circuit is then closed again by controlling the regulating device via input signal e1, e2, which was preset for the selected future first or second regulating mode and represents one of the above-mentioned system deviations, instead of via the switch-over input signal.

At the same time, the regulating device to be deactivated continues to be supplied with the switch-over input signal until this regulating device has been deactivated on the basis of the operating point shift. Alternatively, the regulating device to be deactivated may also be simply shut down.

In a switch-over operation from an instantaneous first or second regulating mode, in which only one regulating circuit is active, to the third regulating mode, in which both regulating circuits 110, 120 are active, regulation management device 130 proceeds as follows:

Via one of control signals St1, St2, it first controls only switch-over device 134, 136 which is assigned to regulating device 114, 124 that is deactivated in the instantaneous regulating mode, but is to be activated for the future regulating mode. The activation operation is carried out in such a way that this switch-over device 134 or 136 supplies the regulating device to be activated with a switch-over input signal u1, u2, which is based on suitable control values that, in turn, are provided by control device 132. A shift in the operating point of the regulating device to be activated is then preferably monitored via control device 138 designed as a state machine to determine when this regulating device actually returns to an active operating range. The point in time at which the operating point enters the active operating range must be distinguished from a different time when the operating point of the regulating device to be activated represents an operating point formed by the future regulating mode; a time interval usually exists between the two points in time.

Once it has been determined that the regulating device to be activated has entered the active operating range, the regulating device that is active in both the instantaneous and the desired future regulating mode, and was previously activated only by input signal e1, e2 of the instantaneous regulating mode, is disconnected from this input signal and instead supplied with the same switch-over input signal u1, u2 as the regulating device to be activated. The same switch-over input signal is preferably supplied to both regulating devices until the two regulating devices have been switched to the active operating state provided for the desired future regulating mode.

Switch-over operations from the first to the second regulating mode and vice versa are preferably not carried out by a switch-over between these regulating modes directly. A direct switch-over of this type would result in disadvantageously strong disturbances in the rail pressure during the switch-over operation. According to the present invention, it is therefore proposed to choose an alternative via the third regulating mode in performing a switch-over operation of this type. Specifically, this means that during a switch-over operation from the first to the third regulating mode, a switch-over operation is to be first carried out from the first to the third regulating mode and then from the third to the second regulating mode. Likewise, a switch-over operation from the second regulating mode to the first regulating mode is accomplished by first switching over from the second to the third regulating mode and then from the third to the first regulating mode. These described switch-over operations, involving the third regulating mode, are preferably carried out as described above.

Control device 138 is designed so that, for each of the above-mentioned switch-over operations, it suitably controls memory device 132 as well as first and second switch-over devices 134, 136, via control signals St1, St2, in particular to suitably implement switch-over input signals u1, u2.

The described method according to the present invention is preferably implemented in the form of a computer program. If necessary, the computer program may be stored together with other computer programs on a computer-readable data medium. The data medium may be a floppy disk, a compact disk or a flash memory. The computer program stored on the data medium may then be transferred or sold to a customer. However, the computer program may also be transmitted to the customer as a product with the help of a data medium, using an electronic communications network, in particular the Internet.

What is claimed is:

1. A method for regulating a pressure in a fuel accumulator of an internal combustion engine, comprising:

performing a steady-state operation of a pressure regulator according to an instantaneous regulating mode;

implementing a switch-over operation for switching the pressure regulator from the instantaneous regulating mode over to a desired future regulating mode in response to a regulating mode signal; and performing the steady-state operation of the pressure regulator according to the future regulating mode;

activating at least one regulating circuit in each regulating mode to regulate the pressure;

during each steady-state operation of the at least one regulating circuit, driving a regulating device individually assigned to each of the at least one regulating circuit by an input signal representing a system deviation;

opening those of the at least one regulating circuit involved in the switch-over operation to perform the switch-over operation according to the implementing of the switch-over operation by activating their respective regulating devices via switch-over input signals that are predetermined individually for each switch-over operation instead of via a previous input signal, the at least one regulating circuit being designed in such a way that the regulating devices are switched in the desired manner from an instantaneous operating state defined by the instantaneous regulating mode over to a future operating state defined by the future regulating mode.

2. The method as recited in claim 1, wherein the switch-over input signals represent predetermined, constant control values that are dimensioned individually depending on the desired switch-over operation.

3. The method as recited in claim 2, wherein the switch-over signals take into account not only the control values, but also an instantaneous rail pressure deviation.

4. The method as recited in claim 1, wherein a transition of the regulating devices from the instantaneous operating state to the future operating state is monitored on the basis of a shift in an operating point of the respective regulating device caused by the switch-over input signals.

5. The method as recited in claim 1, wherein a first, second and third regulating mode are available as alternatives, only a first regulating circuit being activated in a first regulating mode, only a second regulating circuit being activated in a second regulating mode, and both the first and the second regulating circuits being activated in a third regulating mode to regulate the pressure.

6. The method as recited in claim 5, wherein during a switch-over operation from the third regulating mode to the first regulating mode or the second regulating mode, performing the following:

opening the first and second regulating circuits by controlling both the regulating device to be deactivated during the switch-over operation and the one remaining active, via the same switch-over input signals representing the predetermined control values instead of via the input signals from the instantaneous steady-state regulating operation;

monitoring the shift in the operating points of the regulating devices caused by the switch-over input signals and performance of the following steps when the regulating device to be deactivated leaves its instantaneous active operating range:

shutting off the previous switch-over input signal representing the preset control values for the regulating circuit which remains active, and closing of this regulating circuit by activating its regulating device via a different input signal that is predefined according to the performing of the steady-state operation of the pressure regulator according to the future regulating mode and the selected future first or second regulating mode and represents a system deviation; and continuing control of the regulating device of the regulating circuit to be deactivated via the switch-over input signals until its regulating device has been deactivated on the basis of the operating point shift;

and, during the performing of the steady-state operation of the pressure regulator according to the future regulating mode, maintaining the deactivated regulating circuit in the deactivated state either by continuing to suitably activate it via the switch-over input signal, or by shutting down this regulating circuit preferably to a standby mode.

7. The method as recited in claim 5, wherein the switch-over operation from the instantaneous first regulating mode or second regulating mode to the third regulating mode includes performing the following:

controlling the regulating device that is currently deactivated in the instantaneous regulating mode and is to be activated for the future regulating mode via a suitable switch-over input signal;

monitoring the shift, produced by the controlling operation, in the operating point of the regulating device of the regulating circuit to be activated to determine when the currently deactivated regulating device returns to an active operating range; and continued controlling of the regulating device to be activated via the switch-over signal beyond the time at which the determination was made according to the monitoring of the shift and simultaneous opening of the regulating circuit, activated during the instantaneous and the future regulating modes, by controlling its regulating device via the same switch-over signal as the regulating device to be activated, until both regulating devices have been switched to an active operating state as provided for the desired future third regulating mode.

8. The method as recited in claim 1, wherein a transition from the instantaneous regulating mode to a future regulating mode includes:

performing a switch-over operation from the instantaneous regulating mode to a first other regulating mode; and performing a switch-over operation from the instantaneous regulating mode to a second other regulating mode.

9. The method as recited in claim 5, wherein during operation according to the third regulating mode, the input signals for both regulating devices not only represent a system deviation assigned to its own regulating circuit, but also represent a system deviation assigned to the other regulating circuit.

10. A device for regulating a pressure in a fuel accumulator of an internal combustion engine according to one of multiple available regulating modes, which are switchable from an instantaneous regulating mode over to a future one in response to a regulating mode signal, comprising:

at least one first and one second regulating circuit, each having a subtraction device for providing a system deviation and each having a regulating device for regulating the pressure in the fuel accumulator during steady-state regulating operation in response to an input signal representing at least one of the system deviations, the first and/or the second regulating circuit being activated depending on the currently set regulating mode; and a regulation management device that includes the subtraction devices and generates a first and a second switch-over input signal from predetermined control values in response to the regulating mode signal, and to control the first and second regulating devices during a non-steady-state switch-over operation triggered by the regulating mode signal via the switch-over input signals instead of via the input signals, so that the regulating devices are switched in the desired manner from an instantaneous operating state defined by the instantaneous regulating mode over to a future operating state defined by the future regulating mode.

11. The device as recited in claim 10, wherein:

the first regulating circuit includes not only the first regulating device, but also a throttle valve as an actuator for setting the fuel volume supplied to a fuel pump, connected to the fuel accumulator, for pumping fuel into the fuel accumulator a first of the two subtraction devices provides a first system deviation in the form of a volume deviation between the fuel volume currently provided by the throttle value in the form of an actual variable and a predefined setpoint fuel volume; and the first regulating device indirectly regulates the pressure in the fuel accumulator during a steady-state regulating operation by suitably controlling the throttle valve in response to the input signal that is generated by a first switch-over device assigned to the regulation management device and represents at least the volume deviation.

12. The device as recited in claim 10, wherein:

the second regulating circuit includes not only the second regulating device but also a pressure regulating valve as an actuator connected to the fuel accumulator;

the second of the two subtraction devices provides a pressure deviation between the instantaneous pressure in the fuel accumulator and a predefined setpoint pressure; and the second regulating device directly regulates the pressure in the fuel accumulator during a steady-state regulating operation via the pressure regulating valve in response to the second input signal that is generated by a second switch-over device assigned to the regulation management device and that represents at least the pressure deviation.

13. The device as recited in claim 12, wherein:

during a first regulating mode in which the pressure in the fuel accumulator is regulated only with the help of the first regulating circuit, the first switch-over device is designed to form the input signal for the first regulating device in response to a first control signal of a control device assigned to the regulation management device so that it represents the pressure deviation provided by the second subtraction device; and the second switch-over device forms the input signal for the second regulating device in response to a second control signal of the control device on the basis of at least one of the preset control values so that the regulating device of the second regulating circuit remains deactivated or is shut down.

14. The device as recited in claim 12, wherein:

during a second regulating mode in which the pressure in the fuel accumulator is regulated only with the help of the second regulating circuit, the first switch-over device forms the input signal for the first regulating device in response to a first control signal of a control device, assigned to the regulation management device, on the basis of at least one of the preset control values so that the regulating device of the first regulating circuit remains deactivated or is shut down; and the second switch-over device is designed to form the input signal for the second regulating device in response to a second control signal of the control device so that it represents a pressure deviation currently being provided by the second subtraction device.

15. The device as recited in claim 12, wherein:

during a third regulating mode in which the pressure in the fuel accumulator is regulated with the help of the first and second regulating circuits, the first switch-over device is designed to form the input signal for the first regulating device in response to a first control signal of a control device assigned to the regulation management device so that it represents a system deviation which reflects the instantaneous volume deviation provided by the first subtraction device and simultaneously also reflects the instantaneous pressure deviation provided by the second subtraction device; and the second switch-over device is designed to likewise form the input signal for the second regulating device in response to a second control signal of the control device so that it represents a system deviation that reflects the instantaneous pressure deviation and the instantaneous volume deviation.

16. The device as recited in claim 13, wherein:

the control device, at least during a switch-over operation initiated by the regulating mode signal, monitors a shift in the operating point of the affected regulating devices caused by controlling them via the switch-over signals and to generate the control signals for controlling the first and second switch-over devices in response to the detected desired shift in the operating points.

17. A computer program having program on a tangible computer readable medium code for a device for regulating a pressure in a fuel accumulator, the program code when executed resulting in a performance of the following:

performing a steady-state operation of a pressure regulator according to an instantaneous regulating mode;

implementing a switch-over operation for switching the pressure regulator from the instantaneous regulating mode over to a desired future regulating mode in response to a regulating mode signal; and performing the steady-state operation of the pressure regulator according to the future regulating mode;

activating at least one regulating circuit in each regulating mode to regulate the pressure;

during each steady-state operation of the at least one regulating circuit, driving a regulating device individually assigned to each of the at least one regulating circuit by an input signal representing a system deviation;

opening those of the at least one regulating circuit involved in the switch-over operation to perform the switch-over operation according to the implementing of the switch-over operation by activating their respective regulating devices via switch-over input signals that are predetermined individually for each switch-over operation instead of via a previous input signal, the at least one regulating circuit being designed in such a way that the regulating devices are switched in the desired manner from an instantaneous operating state defined by the instantaneous regulating mode over to a future operating state defined by the future regulating mode.

18. The method as recited in claim 1, wherein:

the internal combustion engine includes a common rail system.

19. The device as recited in claim 10, wherein:

the internal combustion engine includes a common rail system.

* * * * *